US005809370A

United States Patent [19]

Ueno

[11] Patent Number: 5,809,370

[45] Date of Patent: Sep. 15, 1998

[54] IMAGE FORMING APPARATUS CAPABLE OF LOADING CARTRIDGE

[75] Inventor: Fumihiro Ueno, Mishima, Japan

[73] Assignee: Canon Kabushiki Kaisha, Tokyo, Japan

[21] Appl. No.: 919,356

[22] Filed: Aug. 28, 1997

[30] Foreign Application Priority Data

Sep. 5, 1996 [JP] Japan ..... 8-254011

[51] Int. Cl.[6] ..... G03G 15/08; G03G 15/01

[52] U.S. Cl. ..... 399/81; 399/224; 399/119

[58] Field of Search ..... 399/81, 76, 112, 399/114, 119, 223, 224

[56] References Cited

U.S. PATENT DOCUMENTS 5,258,819 11/1993 Kimura et al. .

5,440,373 8/1995 Deki et al. .

5,444,515 8/1995 Haneda et al. .

5,617,188 4/1997 Inomata ..... 399/13

5,617,198 4/1997 Ishikawa et al. ..... 399/27

*Primary Examiner*—R. L. Moses

*Attorney, Agent, or Firm*—Fitzpatrick, Cella, Harper & Scinto

[57] ABSTRACT

In a printer having a toner cartridge drum in which a toner cartridge of each of yellow, magenta, cyan, and black is detachably provided, when the toner cartridge is exchanged by opening a door of the printer and, further, opening a cartridge door, in case of opening and subsequently closing the toner cartridge door, a cartridge change mode is set, and in case of closing the door of the printer, an initial operation of the printer is not immediately performed but the cartridge drum is driven and the cartridge to be exchanged is moved to a taking-out position. When the cartridge change mode is not set, in case of closing the door of the printer, the initial operation of the printer is executed.

16 Claims, 12 Drawing Sheets

IMAGE FORMING APPARATUS CAPABLE OF LOADING CARTRIDGE

BACKGROUND OF THE INVENTION

1. Field of the Invention

The invention relates to an image forming apparatus for forming an image by making a cartridge operative.

2. Related Background Art

Hitherto, a laser beam printer for forming a multicolor image by an electrophotographing system has been known.

For example, in the laser beam printer, a black toner cartridge and three color (yellow, magenta, cyan) toner cartridges are loaded in a main frame and a latent image formed on an image holding member is developed. The developed toner image is multiple-transferred onto an intermediate transfer member and is, further, transferred to a transfer material.

When the transfer material on which the color image was transferred is conveyed to a fixing unit, the color image is fixed. The transfer material is ejected to an ejecting unit by an ejecting roller.

In such a laser beam printer, each toner cartridge is detachably constructed for the main frame. In addition to a main frame door, a toner cartridge door to exchange the toner cartridge and option relation doors are provided for the main frame.

High voltage units for respectively applying a transfer bias voltage and a development bias voltage to a transfer charging device and a developing unit are provided for the laser beam printer. A printer controlling circuit sequentially turns on and off the high voltage units in accordance with a plurality of recording cycles, thereby forming a multicolor image.

FIG. 8 is a block diagram showing a construction of a printer controlling circuit of a conventional laser beam printer. A printer controlling circuit 1*a* is connected to a printer controller 11*a* and has an image forming unit 2*a*, a driving circuit 4*a*, a bias controlling circuit 7*a*, a door open/close detecting unit 25*a*, and a printing unit 54*a*.

The printer controlling circuit 1*a* forms a video signal (VDO) by the image forming unit 2*a* on the basis of an image signal (VDO) of each color from the printer controller 11*a* and supplies it to the driving circuit 4*a*. The driving circuit 4*a* is a circuit to drive a semiconductor laser and generates a laser driving signal.

The printing unit 54*a* outputs an actuator driving signal of a motor, a clutch, a solenoid, or the like in accordance with a print sequence signal and a sensor signal from the image forming unit 2*a*.

The image forming unit 2*a* forms a video signal on the basis of the image signal of each color, outputs the video signals, forms an electrostatic latent image onto the image holding member, and outputs a start signal to the bias controlling circuit 7*a*.

The bias controlling circuit 7*a* outputs a bias signal for transference and development to the high voltage units in accordance with the start signal. The high voltage units develop the electrostatic latent image and transfer the developed image onto a recording paper.

The door open/close detecting unit 25*a* detects door open/close information, namely, any one of toner cartridge door open detecting information, main frame door open detecting information, and option relation door open detecting information and transfers the detected information to the image forming unit 2*a*. The image forming unit 2*a* transfers engine information, as a status, at the time of the image formation to the printer controller 11*a* through a video interface 18*a*.

Subsequently, transmission and reception of signals between the printer controlling circuit 1*a* and printer controller 11*a* will now be described. FIG. 9 is a diagram showing interface signals between the printer controlling circuit 1*a* and printer controller 11*a*. FIG. 10 is a timing chart showing commands and statuses by the interface signals between the printer controlling circuit 1*a* and printer controller 11*a*.

After a power source was turned on, the printer controlling circuit 1*a* sets a PPRDY signal to "true" (L level) when a communication with the printer controller 11*a* is enabled. After confirming that a CPRDY signal from the printer controller 11*a* is "true" (L level), a process for allowing the laser beam printer to enter a printable state is started.

When the laser beam printer enters the printable state, an RDY signal is set to "true". On the other hand, when the communication is enabled, the printer controller 11*a* sets the CPRDY signal to "true" (L level). After setting a CBSY signal to "true" (L level), the printer controller transmits a CMD signal synchronously with a pulse by a CCLK signal.

After transmitting a command by the CMD signal, the CBSY signal is set to "false" (H level). When the command is received by the above procedure, the printer controlling circuit 1*a* sets an SBSY signal to "true" (L level) and, thereafter, transmits an STS signal synchronously with the pulse by the CCLK signal. After the status by the STS signal was transmitted, the SBSY signal is set to "false" (H level).

By the above procedure, the printer controlling circuit 1*a* and printer controller 11*a* transmit and receive the commands and statuses. After confirming that the RDY signal is "true", the printer controller 11*a* sets a PRNT signal to "true".

On the other hand, when recognizing that the PRNT signal is "true", the printer controlling circuit 1*a* starts a pre-rotating operation of an electrophotographing process and detects a reference signal and, subsequently, generates a pulse of a TOP signal after the elapse of a t1 time. The printer controller 11*a* generates the image signal (VDO) of yellow synchronously with a pulse of an LSYNC signal. By a similar procedure, image signals of magenta, cyan, and black are generated, thereby forming a multicolor image.

Subsequently, a printing operation of the laser beam printer will now be described. FIG. 11 is a flowchart showing a print processing procedure in the printer controlling circuit 1*a*. This process is started after the power source was turned on and a hardware circuit and a communication were initialized. First, the printer controlling circuit 1*a* enters a state of waiting a correct ID command of the laser beam printer (LBP) from the printer controller 11 (step S10).

When it is determined that the correct ID command of the LBP was received, an initial process is executed (step S11). As an initial process, for example, an activating process such as discrimination about presence or absence of a developing device, start of adjustment of a temperature of a fixing heater, initialization of a driving system, and the like which enable the printing operation is executed. When a failure is detected by a self diagnosis in this instance, the processing routine is finished as a failure.

The apparatus waits until the printer enters a standby state such that the fixing temperature reaches a target temperature or the like (step S12). When the printer enters the standby state, paper presence/absence information from a paper presence/absence detecting unit (not shown) is checked (step S13). When no paper exists, the processing routine is returned to the process in step S12. When there is a paper, a check is made to see if there is a print instruction, namely, whether the PRNT signal is "true" or "false" (step S14).

When there is a print instruction, a print sequence of the electrophotographing process is executed (step S15) and an image is outputted.

A check is made to see if the printing operation has been finished (step S16). The print sequence is executed until the end of the printing operation. When the printing operation is finished, a process to return to the standby operation is executed and the processes from step S12 are repeated.

When the door open state is detected by the door open/close detecting unit 25*a*, an interruption processing procedure is executed. FIG. 12 is a flowchart showing the interruption processing procedure. When the door open state is detected and the door is being opened, the apparatus waits until the door closing state is detected (step S17). When the door is closed, the processing routine advances to the execution of the process in step S11.

In the above conventional image forming apparatus, however, the door is opened in order to exchange a toner cartridge, one toner cartridge is exchanged, and even if the user tries to further move the toner cartridge to a taking-out position for the purpose of exchange, a power voltage of 24V has already been shut off by the door open state, so that the apparatus cannot be driven.

When the door is closed, the initial process (step S11) is started by the detection of the door closing state after the door open state was detected.

For example, when two or more toner cartridges among four toner cartridges indicate an advance notice of the absence of toner, one toner cartridge is moved to a taking-out position, the door is opened, and the toner cartridge is exchanged to a new one. In order to exchange the next toner cartridge, the operations such that the door is again closed, the apparatus waits until the end of the initial process of the engine, a desired toner cartridge is again moved to the taking-out position, the door is opened, and the toner cartridge is exchanged to a new one have to be performed. The exchanging work is troublesome and a long toner exchanging time is required. There is consequently an inconvenience such that a user interface deteriorates.

SUMMARY OF THE INVENTION

It is an object of the invention to provide an image forming apparatus which can eliminate the foregoing drawbacks and a control method for such an apparatus.

Another object of the invention is to provide an image forming apparatus which can reduce an exchanging time of a plurality of cartridges and a control method for such an apparatus.

Still another object of the invention is to provide an image forming apparatus for performing a proper initial operation after a door of the apparatus was closed and a control method for such an apparatus.

The above and other objects and features of the present invention will become apparent from the following detailed description and the appended claims with reference to the accompanying drawings.

BRIEF DESCRIPTION OF THE DRAWINGS

FIG. 5 is a flowchart showing an operation processing procedure of a driving circuit 53 in the cartridge change mode or the like;

DETAILED DESCRIPTION OF THE PREFERRED EMBODIMENT

An embodiment of the invention will now be described hereinbelow in detail with reference to the drawings.

An image forming apparatus in the embodiment is a laser beam printer for forming a full color image by an electrophotographing system.

According to the laser beam printer of the embodiment, a toner cartridge of black and three color (yellow, magenta, cyan) toner cartridges are set in the main frame. A color toner image which was sequentially developed by toner of each color and multiple-transferred to an intermediate transfer member is transferred onto a transfer material, thereby forming a full color image. When the transfer material is conveyed to a fixing unit, the color image is fixed onto the transfer material. The transfer material on which the color image was fixed is ejected to an ejecting unit by an ejection roller. Each toner cartridge is detachably constructed for the main frame.

In addition to a main frame door for the operator to access the inside of the printer, a toner cartridge door to exchange the toner cartridge and option relation doors are also provided for the main frame of the laser beam printer. The open/closing states of those doors are detected by a door open/close detecting unit, which will be explained hereinlater.

Figure 7:
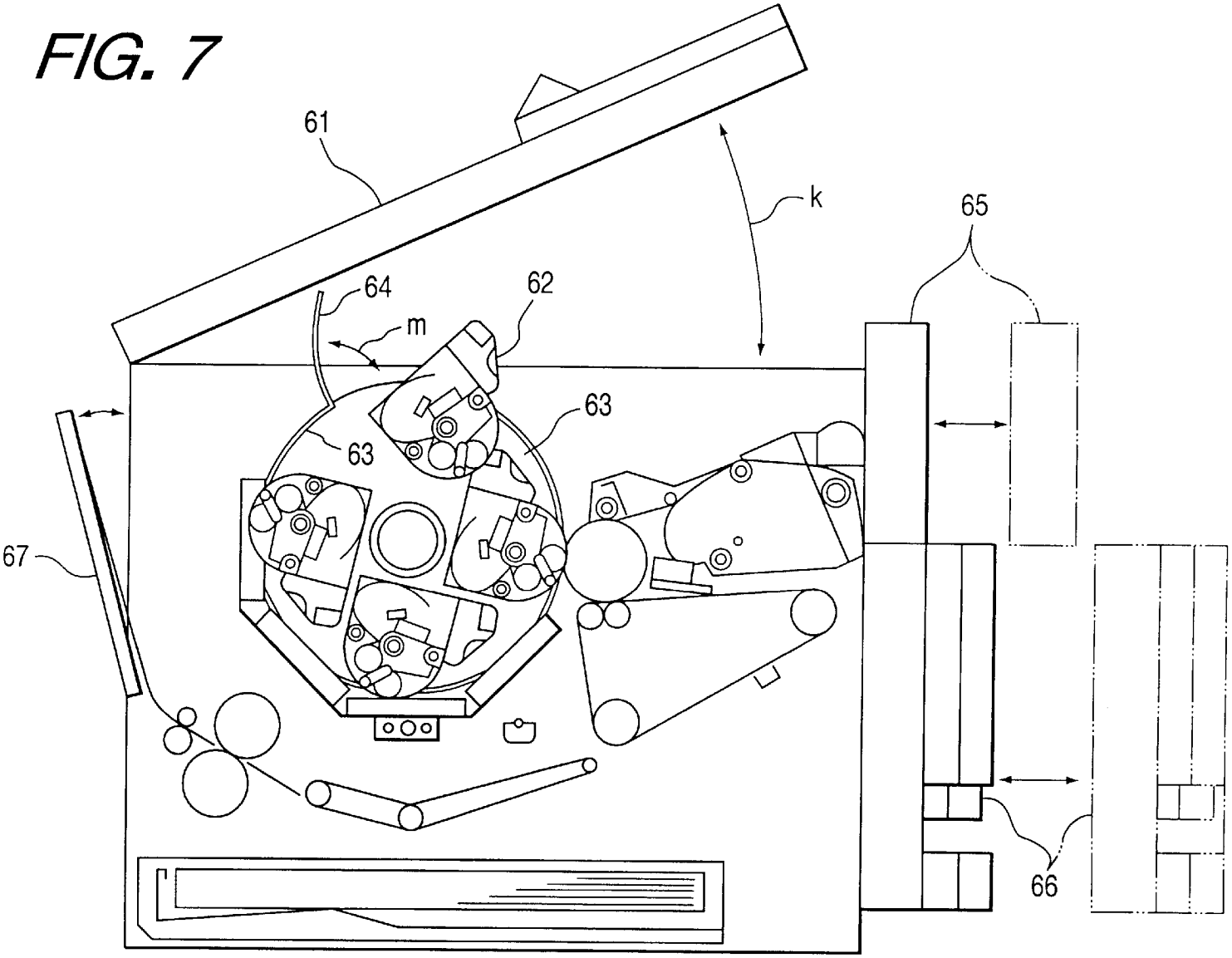
FIG. 7 is a diagram showing open/closing states of various doors including the toner cartridge door.
Figure 8:
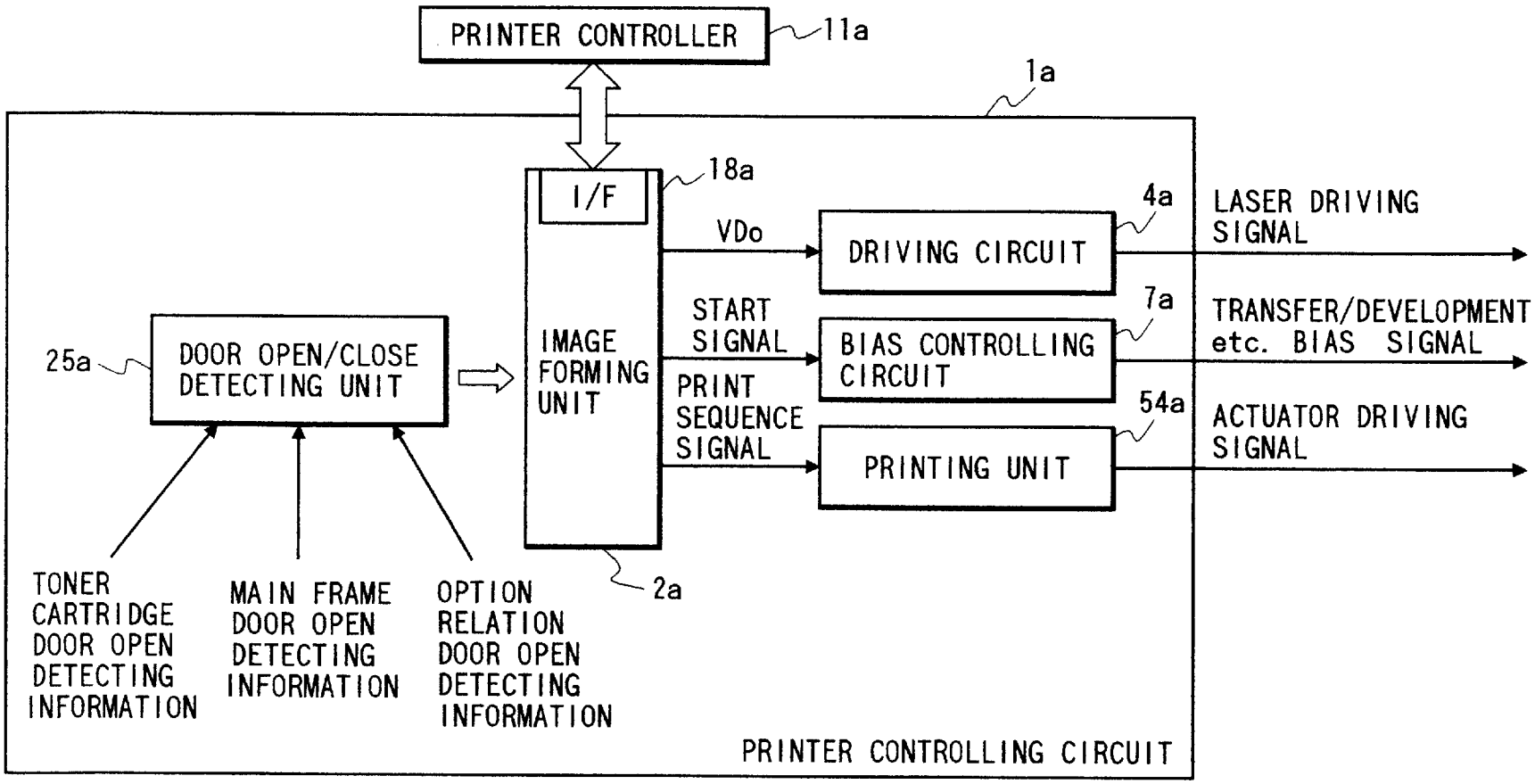
FIG. 8 is a block diagram showing a construction of a printer controlling circuit of a conventional laser beam printer.

FIG. 7 is a diagram showing open/closing states of various doors including the toner cartridge door. An upper cover 61 which is rotatable in the directions shown by arrows (k) in the diagram is provided as a main frame door in the upper portion of the laser beam printer main frame. A toner cartridge door 64 which is rotatable in the directions shown by arrows (m) in the diagram is provided every toner cartridge for the side of a drum 63 to hold a toner cartridge 62. By opening the upper cover 61 and, further, by opening the toner cartridge door 64, the toner cartridge 62 can be exchanged.

A photosensitive drum cartridge taking-out door 65 and an intermediate transfer belt door 66 are provided as option relation doors on the right side of the printer main frame so that they can be freely pulled out. Further, a paper ejecting portion door 67 which forms a paper ejecting port is rotatably provided on the left side of the main frame.

Figure 1:
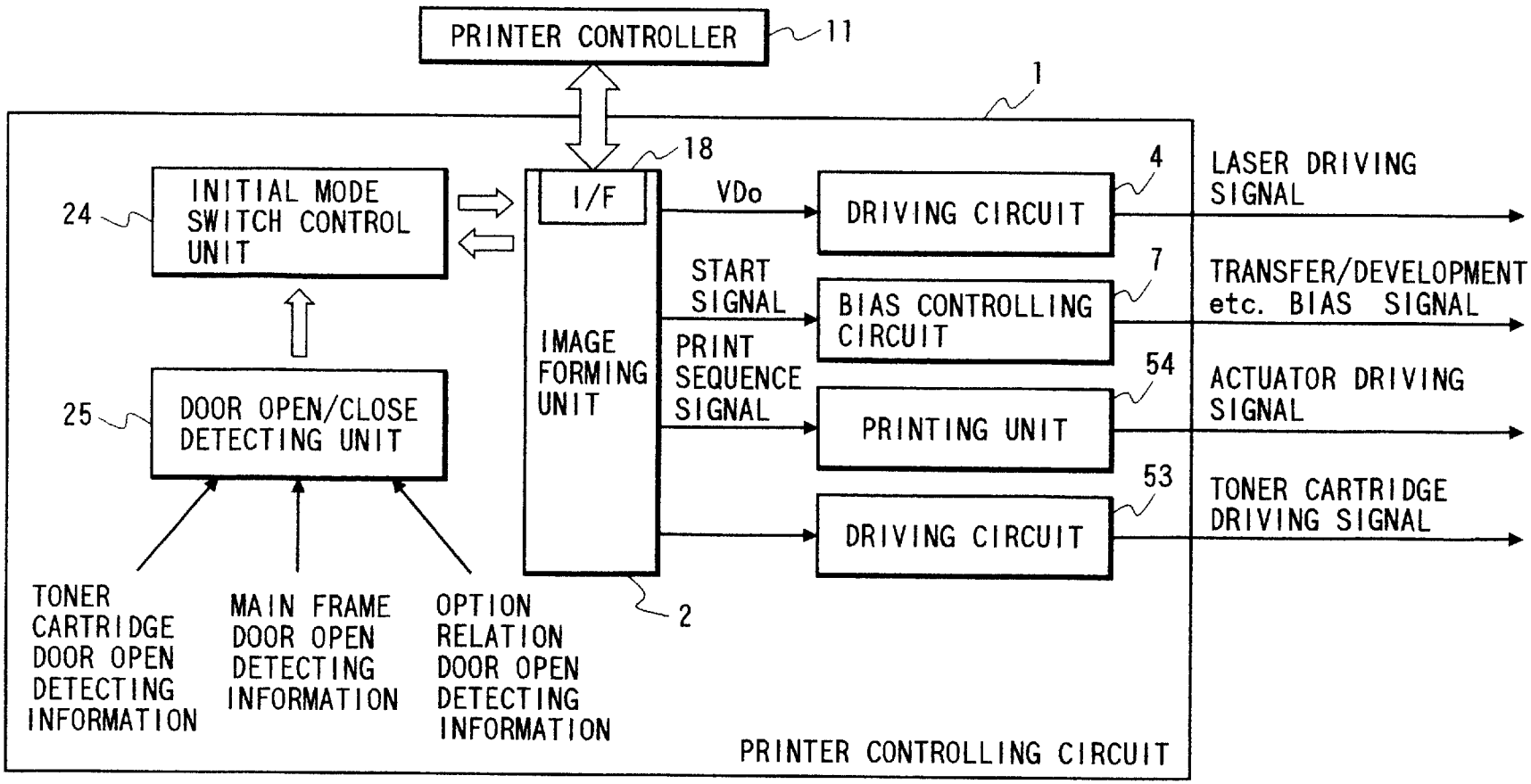
FIG. 1 is a block diagram showing a construction of a printer controlling circuit of a laser beam printer.

FIG. 1 is a block diagram showing a construction of a printer controlling circuit of the laser beam printer. A printer controlling circuit 1 has an image forming unit 2, a driving circuit 4, a bias controlling circuit 7, an initial mode switch control unit 24, a door open/close detecting unit 25, a driving circuit 53, and a printing unit 54.

The printer controlling circuit 1 is connected to a printer controller 11, forms the video signal (VDO) by the image forming unit 2 on the basis of the image signal (VDO) of each color from the printer controller 11, and outputs the video signal to the driving circuit 4. The driving circuit 4 is a circuit to drive a semiconductor laser and outputs a laser driving signal.

The image forming unit 2 forms a video signal on the basis of the image signal of each color from the printer controller 11, outputs the video signal to the driving circuit 4, forms an electrostatic latent image onto an image holding member by the driving circuit 4, and outputs a start signal to the bias controlling circuit 7. The image forming unit 2 transfers engine information at the time of image formation as a status to the printer controller 11 through a video interface (I/F) 18.

The bias controlling circuit 7 outputs bias signals of transfer/development and the like to various high voltage units in accordance with the start signal. Bias voltages are applied to a transfer charging device and a developing unit by the various high voltage units, an electrostatic latent image is developed and transferred onto the recording paper, and a multicolor image is formed.

The initial mode switch control unit 24 switches a mode for executing an ordinary initial process when the door is closed or a mode for shifting to a cartridge change mode or the like in accordance with toner cartridge door open detecting information, main frame door open detecting information, or option relation door open detecting information from the door open/close detecting unit 25.

The door open/close detecting unit 25 detects the open/close information of the doors, namely, any one of the toner cartridge door open detecting information, the main frame door open detecting information, and the option relation door open detecting information and transfers the detected detecting information to the initial mode switch control unit 24. The open/close information of each door is formed by a signal from a sensor provided for each door.

The driving circuit 53 generates a toner cartridge driving signal for moving a toner cartridge of a desired color among the toner cartridges 62 of the respective colors (yellow, cyan, magenta, black) to a taking-out position.

The printing unit 54 generates an actuator driving signal for driving a motor, a clutch, and a solenoid in accordance with a print sequence signal from the image forming unit 2 and sensor signals (not shown).

Figure 9:
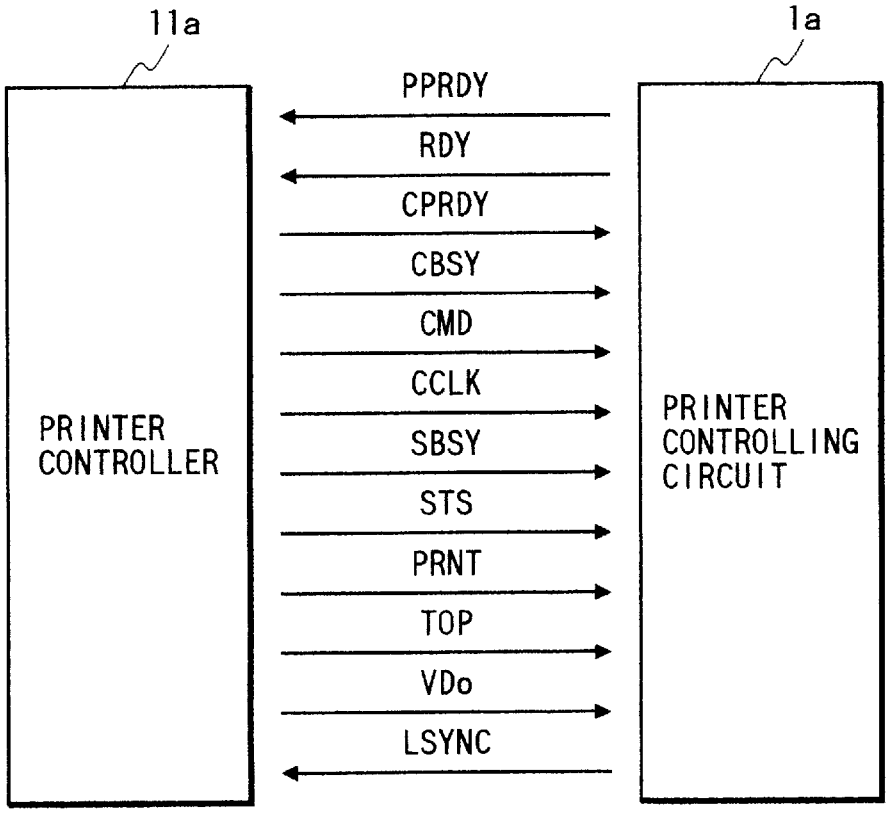
FIG. 9 is a diagram showing interface signals between a printer controlling circuit 1*a* and printer controller 11*a;*
Figure 10:
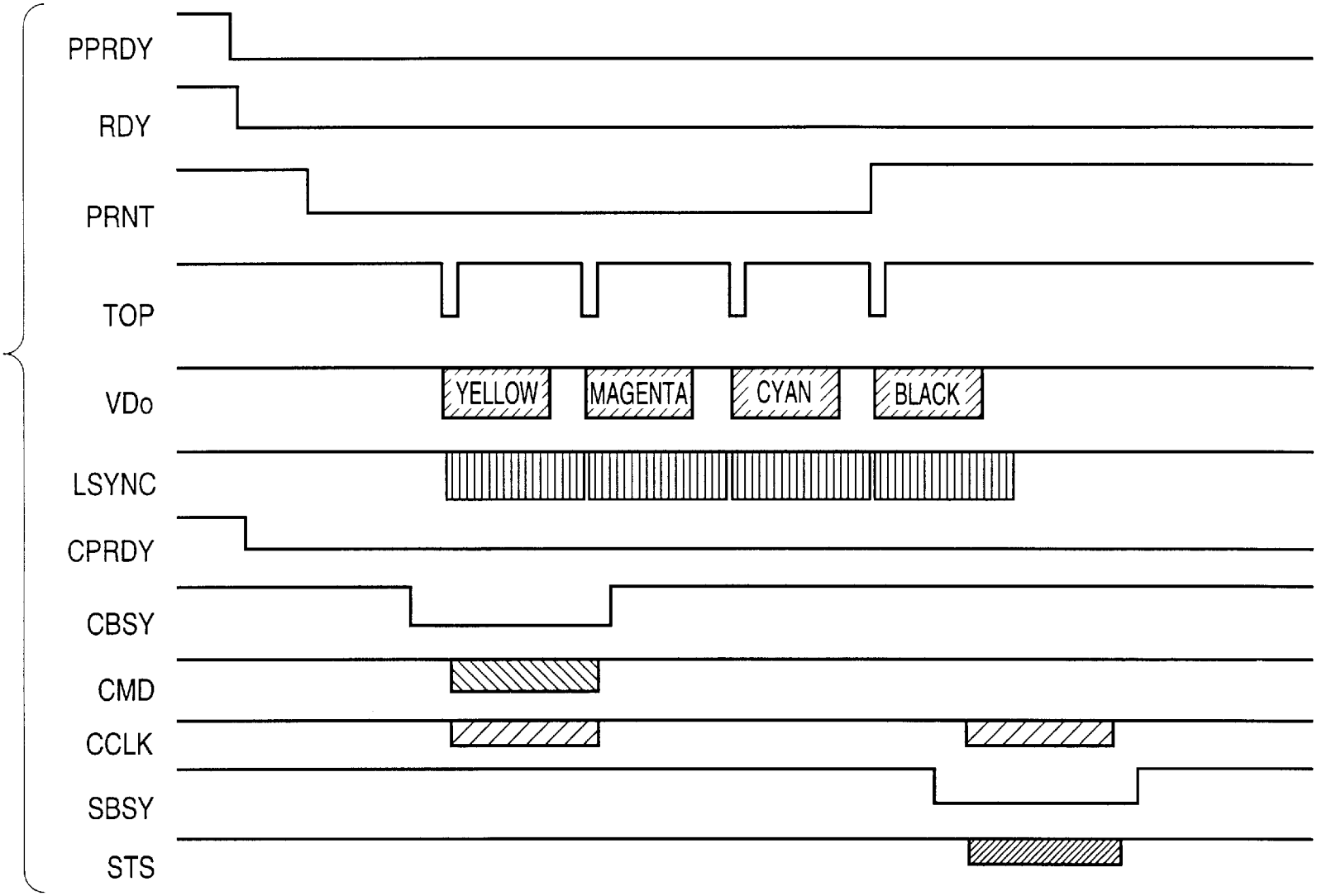
FIG. 10 is a timing chart showing commands and statuses by the interface signals between the printer controlling circuit 1*a* and printer controller 11*a;*
Figure 11:
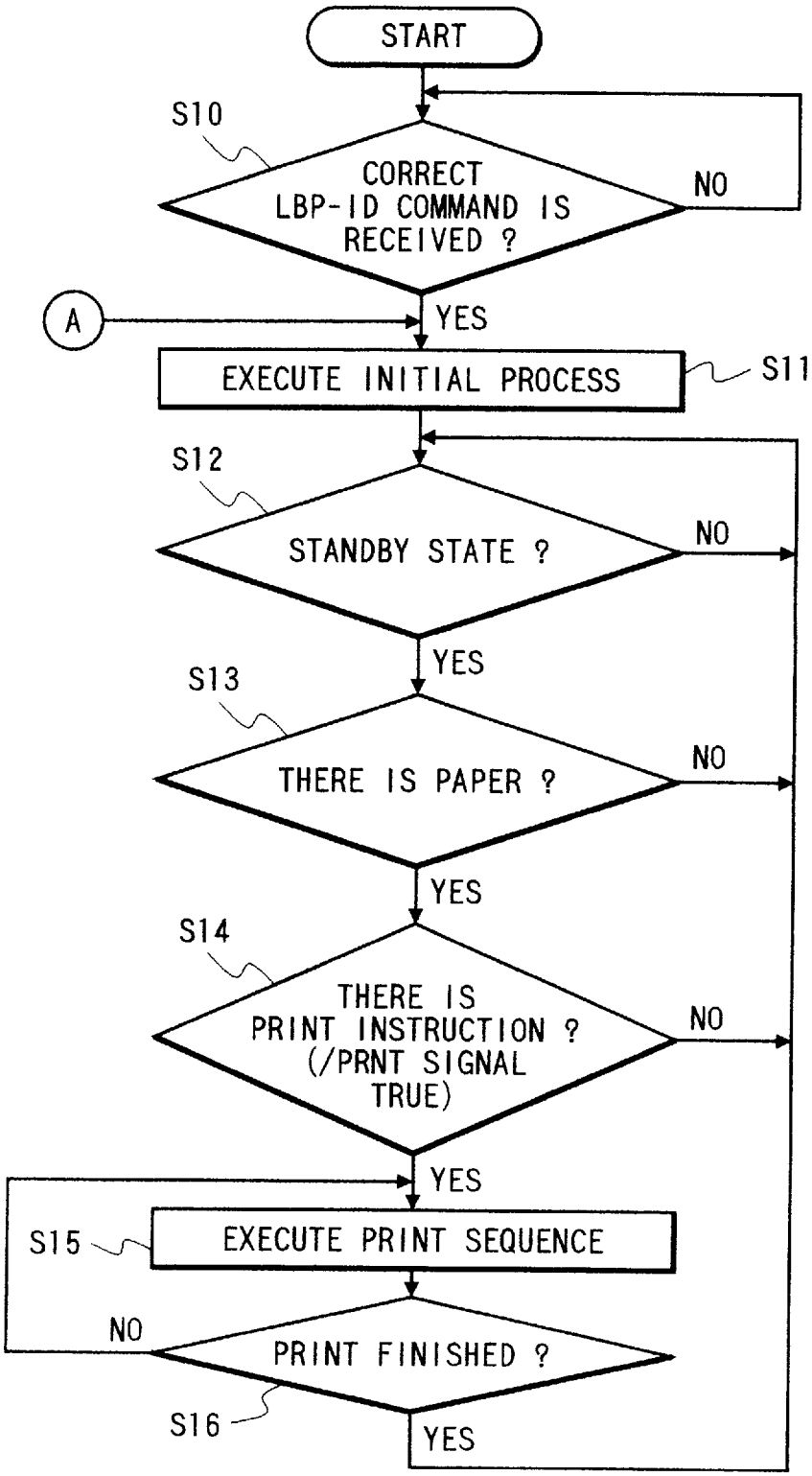
FIG. 11 is a flowchart showing a print processing procedure.
Figure 12:
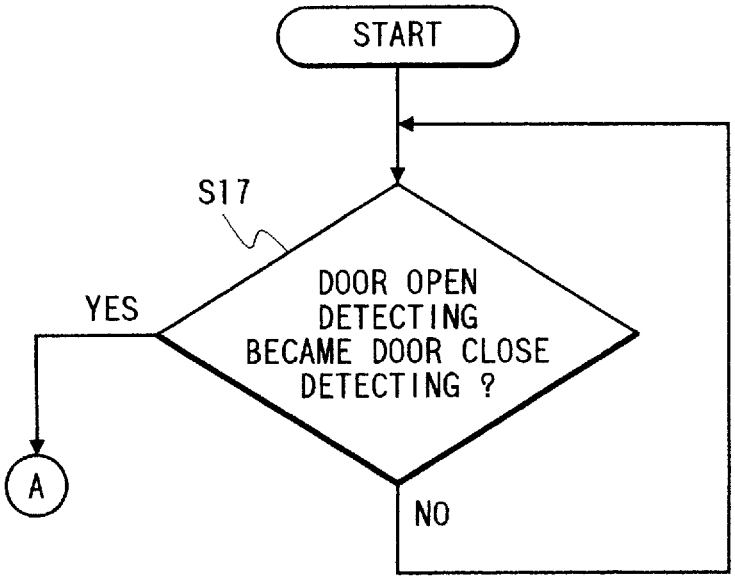
FIG. 12 is a flowchart showing an interruption processing procedure.

Subsequently, transmission and reception of signals between the printer control circuit 1 and printer controller 11 will now be described (refer to FIGS. 9 and 10).

After a power source of the printer main frame was turned on, the printer controlling circuit 1 sets the PPRDY signal to "true" (L level) when a communication with the printer controller 11 is enabled. After confirming that the CPRDY signal from the printer controller 11 is "true" (L level), a process for allowing the laser beam printer to enter a printable state is started.

When the printer enters the printable state, the RDY signal is set to "true". When the communication is enabled, the printer controller 11 sets the CPRDY signal to "true" (L level) and sets the CBSY signal to "true" (L level). After that, the printer controller 11 transmits the CMD signal synchronously with the pulse by the CCLK signal.

After the command by the CMD signal was transmitted, the CBSY signal is set to "false" (H level). When the command is received by the above procedure, the printer control circuit 1 sets the SBSY signal to "true" (L level) and, after that, transmits the STS signal synchronously with the pulse by the CCLK signal. After the status by the STS signal was transmitted, the SBSY signal is set to "false" (H level).

By the above procedure, the printer controlling circuit 1 and printer controller 11 transmit and receive commands and statuses. After confirming that the RDY signal is "true", the printer controller 11 sets the PRNT signal to "true". When it is recognized that the PRNT signal is "true", the printer controlling circuit 1 starts the pre-rotating operation of the electrophotographing process and detects a reference signal and, after that, generates the pulse of the TOP signal after the elapse of a time t1. The printer controller 11 generates the image signal (VDO) of yellow synchronously with the pulse of the LSYNC signal. By a similar procedure, image signals of magenta, cyan, and black are generated, thereby forming a multicolor image.

When the power source is turned on, the printer controlling circuit 1 executes an initial process such that an output port connected to the image forming unit 2 is turned off and whether an input port of a sensor or the like is abnormal or not is discriminated and the like. After that, the printer controlling circuit 1 informs the printer controller 11 of a status of the printer operation through the video interface 18. The printer controlling circuit 1 starts the transmission and reception of the commands from/to the printer controller 11 and executes the initial process of the electrophotographing process. When all of the initial processes are finished, the apparatus waits until the PRNT signal is set to "true" (L level).

Subsequently, the printing operation of the laser beam printer will now be described. This process is started after the power source was turned on and a hardware circuit and the communication were initialized. First, the apparatus waits for the input of a correct ID command of the laser beam printer (LBP) from the printer controller 11.

When it is decided that the correct ID command was received, the initial process is executed. As an initial process, for example, an activating process such as discrimination about the presence or absence of the developing device, start of adjustment of a temperature of a fixing heater, initialization of the driving system, and the like until a standby state in which the printing operation is possible is executed. However, in this instance, when a failure is detected by the self diagnosis, the processing routine is finished as a failure.

The apparatus waits for the standby state such that the fixing temperature reaches a target temperature or the like. When the standby state is obtained, paper presence/absence information from a paper presence/absence detecting unit (not shown) is discriminated. When there is a paper, whether there is a print instruction or not, namely, whether the PRNT signal is "true" or "false" is discriminated.

When there is a print instruction, the print sequence of the electrophotographing process is executed and an image is outputted. Whether the printing operation has been finished or not is discriminated. The print sequence is executed until the end of the printing operation. When the printing operation is finished, a process to return to the standby operation is executed.

Figure 2:
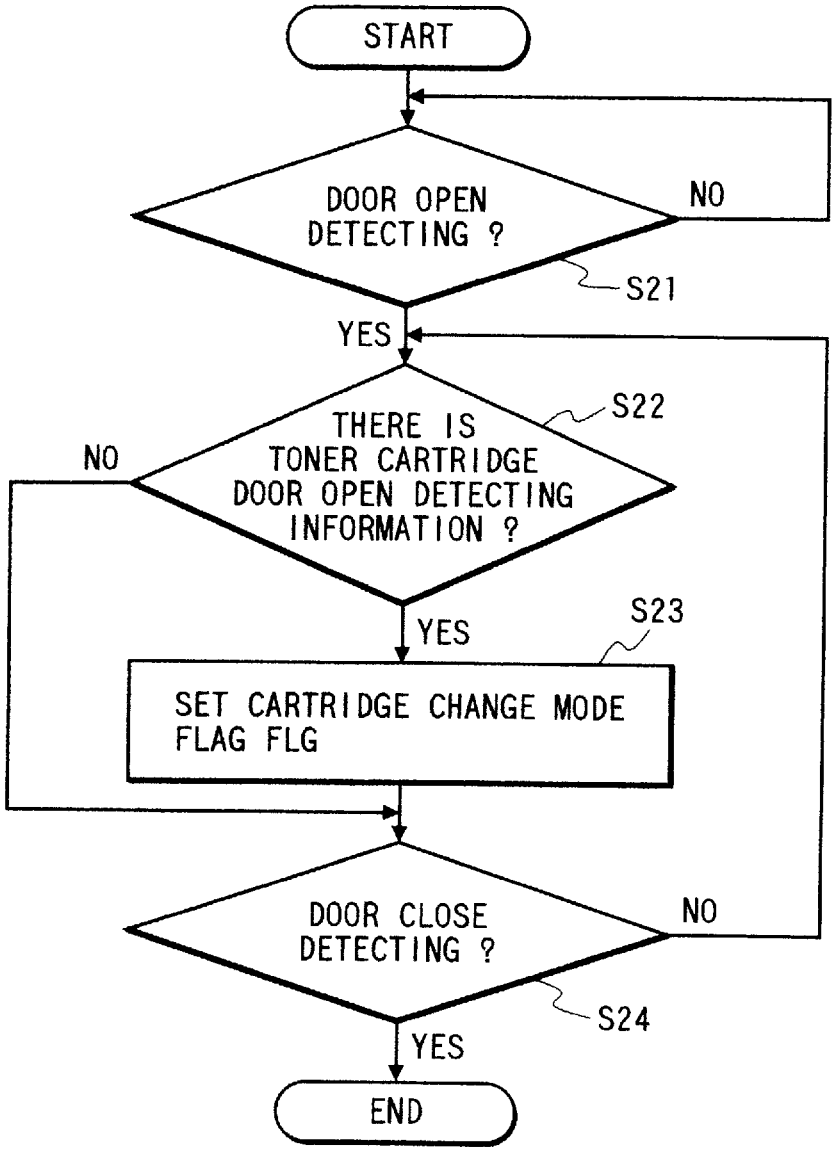
FIG. 2 is a flowchart showing an operation processing procedure of a door open/close detecting unit 25.

Subsequently, an operation processing procedure of the door open/close detecting unit 25 and initial mode switch control unit 24 will now be described. FIG. 2 is a flowchart showing the operation processing procedure of the door open/close detecting unit 25. Whether the door open state has been detected or not is discriminated by each door open information from the sensor provided for each door (step S21). When the door open state is detected, a check is made to see if the toner cartridge door open detecting information exists in the door open information (step S22).

When there is the toner cartridge door open detecting information, a cartridge change mode flag (FLG) is set (step S23). A check is made to see if the door closing state has been detected (step S24). The processes in steps S22 and S23 are repeated until the door closing state is detected. When the door closing state is detected, the processing routine is finished. After that, the processing routine advances to the operating process of the initial mode switch control unit 24.

Figure 3:
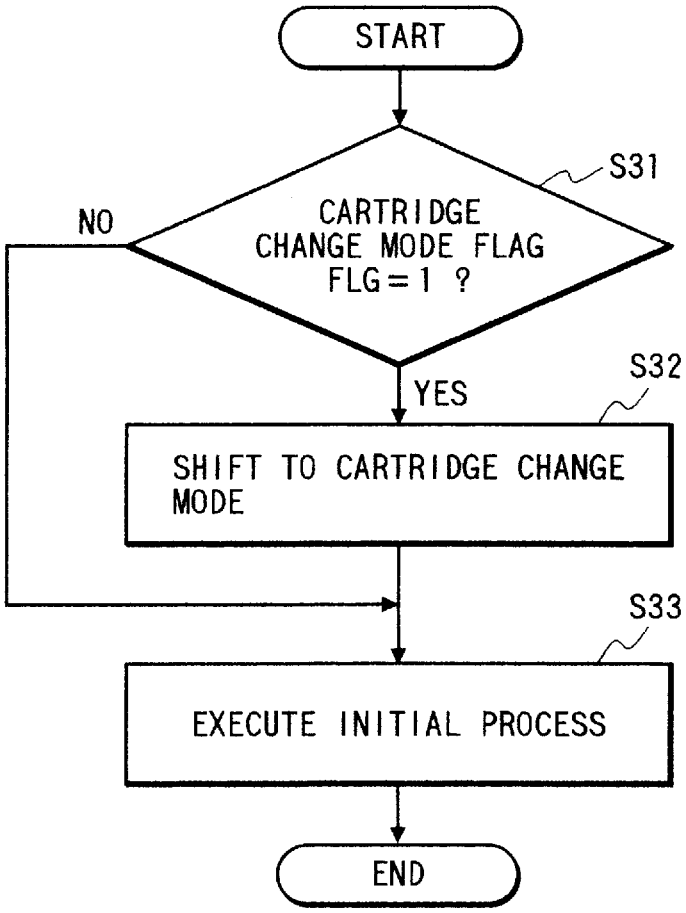
FIG. 3 is a flowchart showing an operation processing procedure of an initial mode switch control unit 24.

FIG. 3 is a flowchart showing an operation processing procedure of the initial mode switch control unit 24. First, when all of the door closing states are detected, a check is made to see if the cartridge change mode flag (FLG)=1 (step S31). When the cartridge change mode flag (FLG)=1, the control mode is shifted to the cartridge change mode (step S32). In the cartridge change mode, a toner cartridge driving signal is generated from the driving circuit 53 and the toner cartridge drum 63 is moved to a predetermined taking-out position. On the other hand, when the cartridge change mode flag (FLG)≠1, the ordinary initial process is executed (step S33). As an initial process, the activating process such as discrimination about the presence or absence of the developing device, start of the adjustment of the temperature of the fixing heater, initialization of the driving system, and the like until the standby state in which the printing operation is enabled is executed in a manner similar to the case of power-on.

Figure 4:
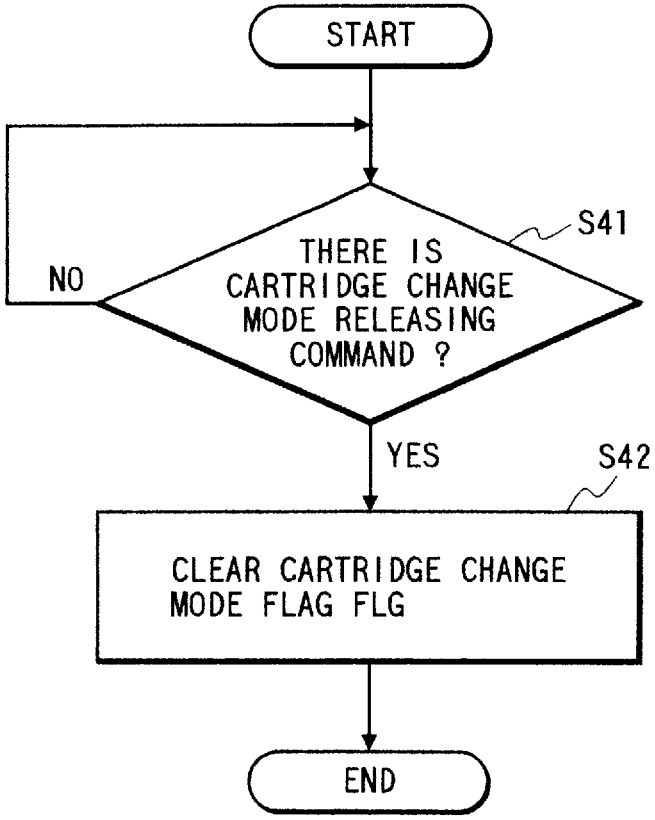
FIG. 4 is a flowchart showing a processing procedure in a-cartridge change mode.

FIG. 4 is a flowchart showing a processing procedure in the cartridge change mode. In the cartridge change mode, first, a check is made to see if there is a releasing command of the cartridge change mode (step S41). When there is a releasing command, the cartridge change mode flag (FLG) is cleared (step S42). After that, the processing routine advances to the initial process in step S33 mentioned above.

Figure 5:
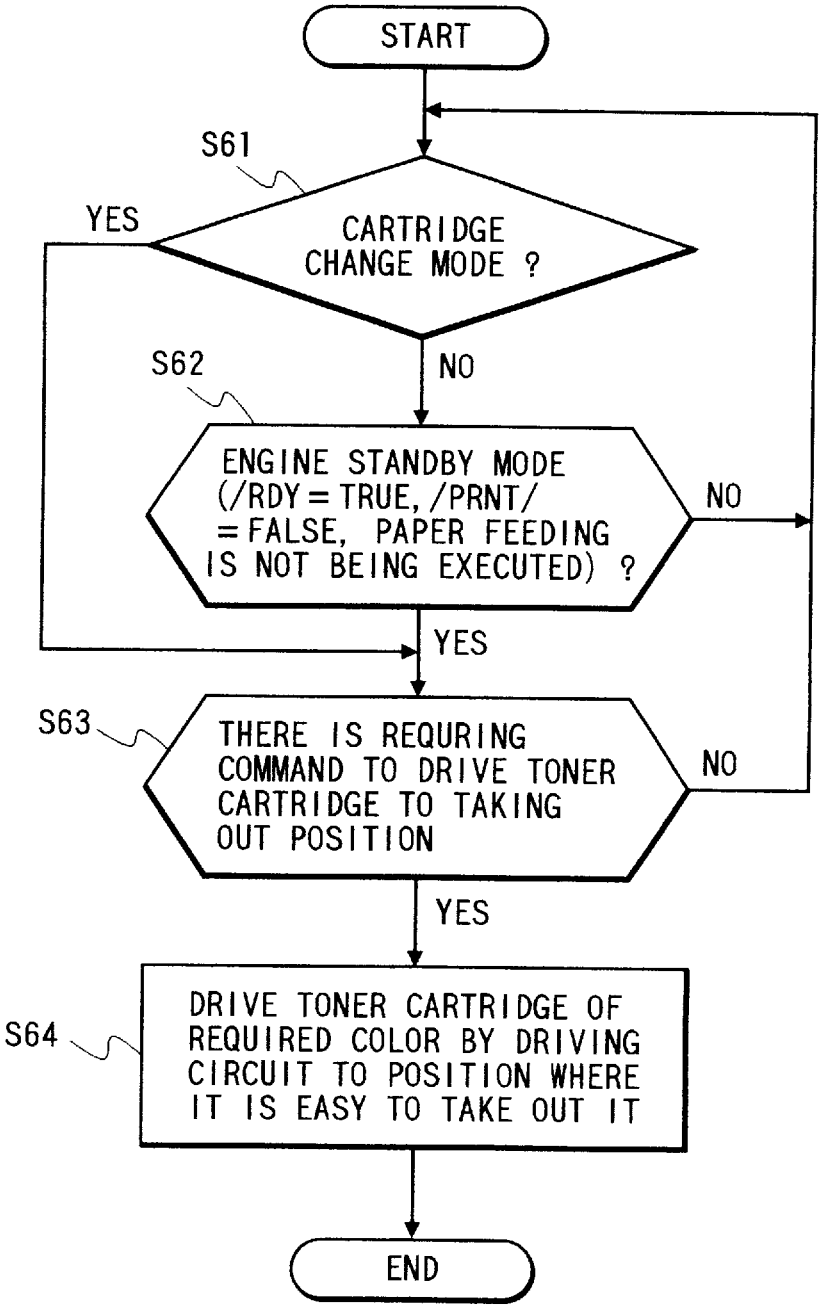

FIG. 5 is a flowchart showing an operation processing procedure of the driving circuit 53 in the cartridge change mode or the like. First, a check is made to see if the control mode is the cartridge change mode or engine standby mode (steps S61, S62). The engine standby mode denotes a case where the RDY signal is "true" (L level) and the PRNT signal is "false" (H level) and the paper is not being conveyed.

In the cartridge change mode or engine standby mode, a check is made to see if there is a command to request to move the toner cartridge 62 to a taking-out position (step S63). For example, when there is a command to request to take out the yellow toner cartridge, the toner cartridge drum is driven and the yellow toner cartridge is moved to the taking-out position (step S64).

When there is not the command to request to take out the yellow toner cartridge in step S63, the processing routine is returned to the process in step S61.

As mentioned above, by switching the mode in accordance with the kind of door to be opened or closed instead of executing the initial process simultaneously with the door closing operation, the work to exchange the toner cartridge is simplified and the cartridge exchanging time can be reduced. Thus, the user interface can be improved.

In the above embodiment, the control mode has been shifted to the cartridge change mode by detecting the open/closing state of the toner cartridge door 64. However, it is also possible to shift to the cartridge change mode by a command from the printer controller 11.

In the construction such that the driving circuit 53 generates the toner cartridge driving signal for moving the toner cartridge 62 to the taking-out position by the command from the printer controller 11, in the case where the operation panel of the printer controller 11 to generate the command is not provided near the taking-out position of the toner cartridge or where there is not a host computer to generate a command by software in the printer driver, it is also possible to move the toner cartridge 62 to the taking-out position by detecting the open/closing state of the toner cartridge door 64.

Figure 6:
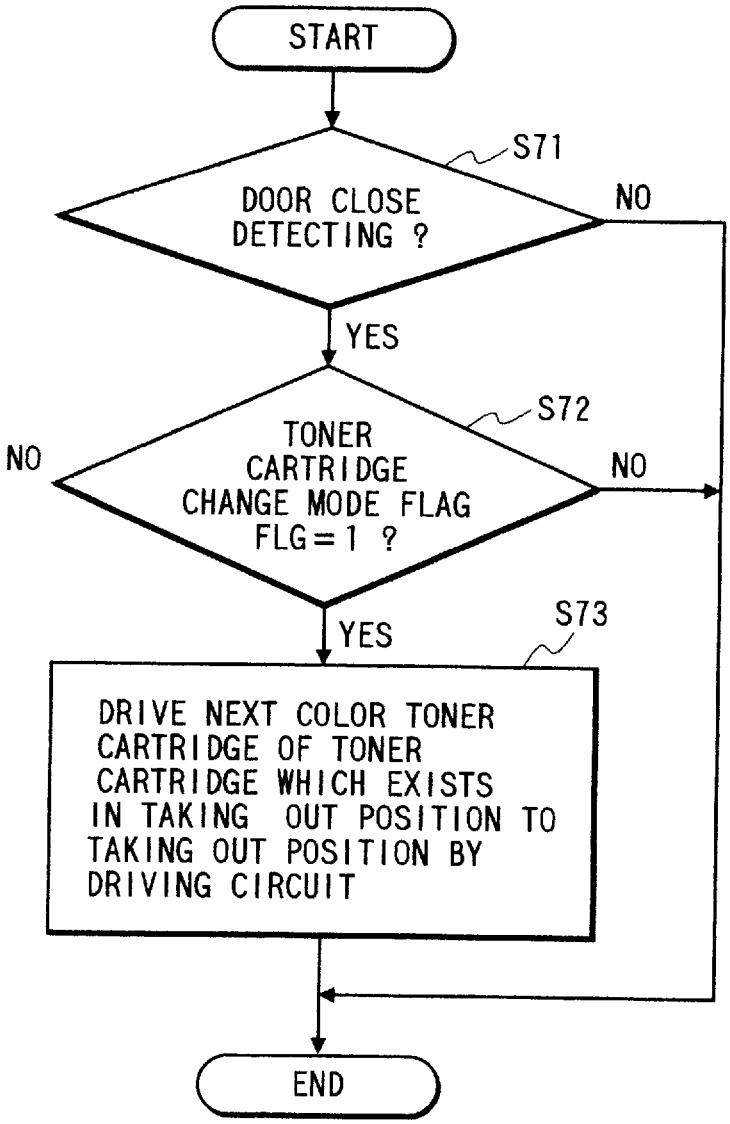
FIG. 6 is a flowchart showing an operation processing procedure in case of moving a toner cartridge to a taking-out position by detecting an open/closing state of a toner cartridge door.

FIG. 6 is a flowchart showing an operation processing procedure in case of moving the toner cartridge to the taking-out position by detecting the open/closing state of the toner cartridge door. When the door closing state is detected by the opening/closing operation of the toner cartridge door 64 (steps S71, S72), a control to move the next toner cartridge 62 to the taking-out position is executed (step S73). The next toner cartridge 62 is not limited to the toner cartridge in which there is an advance notice of the absence of toner but an adjacent toner cartridge can be also used.

With the above construction, even if there is no printer controller at a near location, the movement of the drum 63 in order to exchange the toner cartridge can be performed by opening or closing the door without limiting to the command. The exchanging work of the toner cartridge, therefore, can be simplified and the user interface can be improved.

The invention can be applied to a system constructed by a plurality of equipment or can be also applied to an apparatus constructed by one equipment. It will be obviously understood that the invention can be also applied to a case where the invention is accomplished by supplying a program to a system or an apparatus. In this case, a program expressed by software to accomplish the invention is stored in a storage medium and by reading out the program therefrom to a system or an apparatus, thereby enabling the system or apparatus to obtain an effect of the invention.

The present invention is not limited to the foregoing embodiments but many modifications and variations are possible within the spirit and scope of the appended claims of the invention.

What is claimed is:

1. An image forming apparatus comprising:

cartridge enclosing means in which a cartridge to form an image is detachably provided and which is used to move said cartridge to a predetermined taking-out position;

a plurality of closable doors including a cartridge door for exchanging said cartridge at said taking-out position and a main frame door for operating said cartridge door;

door open/close detecting means for detecting open/closing states of said plurality of doors; and control means for executing an initial operation of said image forming apparatus when a state in which said main frame door was closed from an open state is detected, wherein in the case where a state in which said cartridge door is closed from an open state is detected, when the state in which said main frame door is closed from the open state is detected, said control means does not execute said initial operation but executes a cartridge change mode for driving said cartridge enclosing means, thereby moving said cartridge to said taking-out position.

2. An apparatus according to claim 1, further having input means for inputting a command to release said cartridge change mode, and wherein when said releasing command is inputted, said control means releases said cartridge change mode, thereby allowing said initial operation to be executed.

3. An apparatus according to claim 1, wherein said cartridge is made up of developing cartridges of a plurality of colors to form a color image.

4. An image forming apparatus comprising:

cartridge enclosing means in which a cartridge to form an image is detachably provided and which is used to move said cartridge to a predetermined taking-out position;

a main frame door which is opened or closed for an operator to access the inside of said image forming apparatus;

door open/close detecting means for detecting an open/closing state of said main frame door;

control means for executing an initial operation of said image forming apparatus when a state in which said main frame door was closed from an open state is detected; and input means for inputting an exchange instruction of said cartridge, wherein in the case where the state in which said main frame door is closed from the open state is detected after said exchange instruction was inputted, said control means does not execute said initial operation but executes a cartridge change mode for driving said cartridge enclosing means, thereby moving said cartridge to said taking-out position.

5. An apparatus according to claim 4, wherein when said input means inputs an instruction to release said cartridge change mode, said control means releases said cartridge change mode, thereby allowing said initial operation to be executed.

6. An apparatus according to claim 4, wherein said cartridge is made up of developing cartridges of a plurality of colors to form a color image.

7. An apparatus according to claim 4, wherein said input means inputs an instruction from an operation panel of said image forming apparatus.

8. An apparatus according to claim 4, wherein said input means inputs an instruction from a computer connected to said image forming apparatus.

9. A control method of an image forming apparatus comprising cartridge enclosing means in which a cartridge to form an image is detachably provided and which is used to move said cartridge to a predetermined taking-out position and a plurality of closable doors including a cartridge door for exchanging said cartridge at said taking-out position and a main frame door for operating said cartridge door, comprising the steps of:

a) detecting an open/closing state of said cartridge door;

b) detecting an open/closing state of said main frame door; and c) setting a change mode of said cartridge such that when a state in which said main frame door is closed from an open state is detected without detecting a state in which said cartridge door is closed from an open state, an initial operation of said image forming apparatus is executed, and when the state in which said main frame door is closed from the open state is detected after the state in which said cartridge door is closed from the open state was detected, said initial operation of said image forming apparatus is not executed but said cartridge enclosing means is driven, thereby moving said cartridge to said taking-out position.

10. A method according to claim 9, further having the step of:

d) releasing said cartridge change mode when a command to release said cartridge change mode is inputted, thereby executing said initial operation.

11. A method according to claim 9, wherein said cartridge is made up of developing cartridges of a plurality of colors to form a color image.

12. A control method of an image forming apparatus comprising cartridge enclosing means in which a cartridge to form an image is detachably provided and which is used to move said cartridge to a predetermined taking-out position and a main frame door which is opened or closed for an operator to access the inside of said image forming apparatus, comprising the steps of:

a) detecting an input of an exchange instruction of said cartridge;

b) detecting an open/closing state of said main frame door; and c) setting a change mode of said cartridge such that when a state in which said main frame door is closed from an open state is detected without detecting the input of said exchange instruction, an initial operation of said image forming apparatus is executed, and when the state in which said main frame door is closed from the open state is detected after the input of said exchange instruction was detected, the initial operation of said image forming apparatus is not executed but said cartridge enclosing means is driven, thereby moving said cartridge to said taking-out position.

13. A method according to claim 12, further having the step of:

d) releasing said cartridge change mode when a command to release said cartridge change mode is inputted, thereby executing said initial operation.

14. A method according to claim 12, wherein said cartridge is made up of developing cartridges of a plurality of colors to form a color image.

15. A method according to claim 12, wherein in said step (a), an input of an instruction from an operation panel of said image forming apparatus is detected.

16. A method according to claim 12, wherein in said step (a), an input of an instruction from a computer connected to said image forming apparatus is detected.

* * * * *

UNITED STATES PATENT AND TRADEMARK OFFICE

CERTIFICATE OF CORRECTION

PATENT NO. : 5,809,370

DATED : September 15, 1998

INVENTOR(S) : FUMIHIRO UENO

It is certified that error appears in the above-identified patent and that said Letters Patent is hereby corrected as shown below:

In The Drawings:

SHEET 5

Fig. 5, in Step S63, "REQURING" should read --REQUIRING--; and in Step S64, "OUT IT" should read --IT OUT--.

COLUMN 3

Line 37, "to a" should read --for a--.
Line 42, "to a" should read --for a--.

Signed and Sealed this

Thirtieth Day of March, 1999

*Attest:*

*Attesting Officer*

Q. TODD DICKINSON

*Acting Commissioner of Patents and Trademarks*